US006567632B2

(12) United States Patent
Takano et al.

(10) Patent No.: US 6,567,632 B2
(45) Date of Patent: May 20, 2003

(54) ELECTROPHOTOGRAPHIC DEVICE

(75) Inventors: Yuuichi Takano, Hitachi (JP); Nobuaki Fukasawa, Hitachi (JP); Satoshi Narita, Hitachiohta (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/972,997

(22) Filed: Oct. 10, 2001

(65) Prior Publication Data

US 2002/0081129 A1 Jun. 27, 2002

(30) Foreign Application Priority Data

Dec. 21, 2000 (JP) ..... 2000-388058

(51) Int. Cl.[7] ..... G03G 21/00
(52) U.S. Cl. ..... 399/127
(58) Field of Search ..... 399/167, 127, 399/128

(56) References Cited

U.S. PATENT DOCUMENTS 6,108,502 A * 8/2000 Kawada et al. ..... 399/159

FOREIGN PATENT DOCUMENTS

JP 4-15670 * 1/1992
JP 5-80641 * 4/1993
JP 7-64461 * 3/1995
JP 8-248844 * 9/1996
JP 11-52789 * 2/1999
JP 11-327408 * 11/1999

* cited by examiner

*Primary Examiner*—Quana M. Grainger
(74) *Attorney, Agent, or Firm*—Antonelli, Terry, Stout & Kraus, LLP

(57) ABSTRACT

The rotating speed of a photosensitive body is reduced for preventing deterioration thereof due to ozone in an electrophotographic device which comprises the photosensitive body, a charger which uniformly charges the surface of the photosensitive body, and a motor control unit which performs drive control for a motor which drives the photosensitive body. The motor control unit provides a plurality of speed levels including a first speed level for rotating the photosensitive body during printing and another speed level for rotating the photosensitive body at a reduced speed lower than the speed used during printing. The speed is changed-over between the plurality of speed levels depending on the operating condition. Thereby, deterioration of the photosensitive body due to ozone generated from the charger is prevented, and additional deterioration of the photosensitive body due to rotation thereof other than during a printing operation is also prevented.

6 Claims, 4 Drawing Sheets

ELECTROPHOTOGRAPHIC DEVICE

BACKGROUND OF THE INVENTION

The present invention relates to an electrophotographic printer, such as a laser beam printer, and an electrophotographic device, such as an electrophotographic copying machine, and, in particular, it relates to an electrophotographic device having a rotation control means for a photosensitive body.

JP-A-8-248844 (1996), for example, discloses an electrophotographic device in which, after turning off a changer, a photosensitive body is rotated for a predetermined time based on the driving time of the charger until the turning off, to thereby eliminate deterioration of the photosensitive body due to ozone. Although JP-A-8-248844 (1996) discloses reducing deterioration of the photosensitive body due to ozone by rotating the same for a predetermined time, however, no consideration is given to the possible influence this extended rotation has on the shortening of the life time of the photosensitive body.

Other than deterioration due the affects of the to printing beams and due to ozone, the life time of the photosensitive body is affected by the rotation thereof, in particular, with regard to an electrophotographic device using a belt-shaped photosensitive body, in that, if the photosensitive body is rotated additionally, deterioration of the photosensitive body itself is caused. In particular, with regard to a recent electrophotographic device with a higher printing speed, the deterioration of the photosensitive body appears remarkably when such a measure is employed.

SUMMARY OF THE INVENTION

An object of the present invention is to provide a method of avoiding deterioration due to rotation of a photosensitive body, as well as of preventing deterioration of the photosensitive body and an electrophotographic device main body due to ozone.

In order to achieve the above object, one of features of the electrophotographic device of the present invention is to reduce the rotating speed of the photosensitive body, when rotating the photosensitive body for the purpose of preventing deterioration thereof due to ozone.

Further, another feature of the present invention resides in an electrophotographic device which comprises a photosensitive body; a charger which uniformly charges the surface of the photosensitive body; and a motor control unit which performs drive control for a motor which operates to rotate and stop the photosensitive body, wherein the feature of the invention is characterized in that the motor control unit includes a plurality of speed levels, including a first speed level for rotating the photosensitive body during printing and a second speed level for rotating the photosensitive body, which second speed level is lower than the first speed level used during the printing, and there is provided a speed change-over means, which changes over the control of the motor speed between the plurality of speed levels, depending on the operating condition of the electrophotographic device.

DETAILED DESCRIPTION OF PREFERRED EMBODIMENT

Hereinbelow, an embodiment of the present invention will be explained with reference to the drawings.

Figure 1:
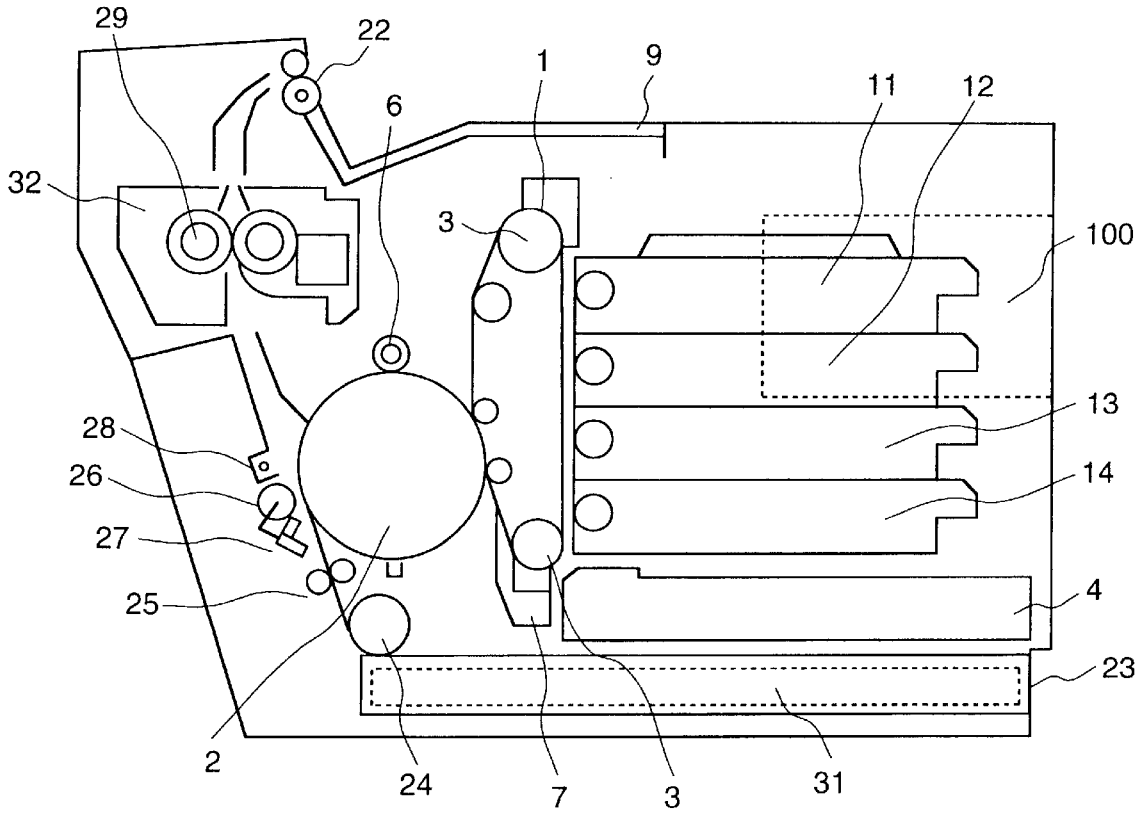
FIG. 1 is a vertical cross sectional schematic diagram of the overall structure of a color laser beam printer according to one embodiment of the present invention.
Figure 2:
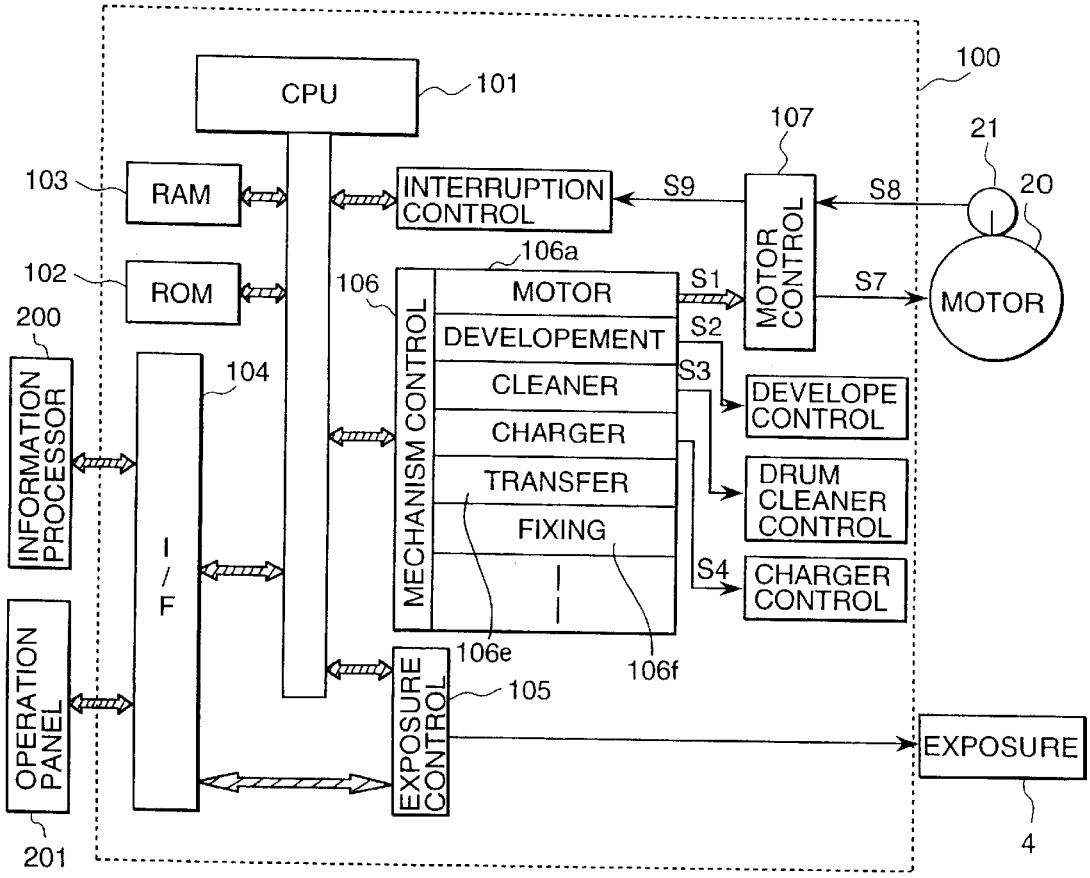
FIG. 2 is a block diagram of the control unit in FIG. 1.

FIG. 1 shows a vertical cross sectional schematic view of the overall structure of a color laser beam printer according to one embodiment of the present invention, and FIG. 2 shows details of the control unit in FIG. 1.

As shown in FIG. 1, while a photosensitive belt 1 rotates around guide rollers 3 with a predetermined speed, the photosensitive belt 1 is uniformly charged by a charger 7 which generates a high voltage, and the photosensitive belt 1 is exposed by laser beams (not shown) emitted from an exposure unit 4 according to image signals of respective colors, so as to successively form electrostatic latent images corresponding to the respective colors. Toner images of the respective colors are then formed by selecting one of the developers using a developing agent of a corresponding color from among four developers 11, 12, 13 and 14 and by successively developing the electrostatic latent images.

The toner images of respective colors on the surface of the photosensitive belt 1 are transferred in an overlapping manner onto the surface of a transfer drum 2, which rotates in synchronism with the photosensitive belt 1, while contacting the surface thereof, to thereby form a color toner image on the surface of the transfer drum 2. Paper sheet 31 representing a recording medium stored in a paper feeding cassette 23 is extracted and delivered by a paper feeding roller 24 and is sent to a register roller 25 so that the delivering timing of the paper sheet 31 and the colored toner image on the surface of the transfer drum 2 are controlled so as to match each other, and, thereafter, the paper sheet 31 is delivered toward a transfer roller 26.

Thereafter, while the paper sheet 31 is in contact with the transfer drum 2, the paper sheet 31 is provided from the back face thereof with a mechanical pressing force and a transfer electric field by the transfer roller 26, whereby, the colored toner image on the surface of the transfer drum 2 is transferred onto the paper sheet 31.

Further, during the process of transferring the toner images of respective colors from the photosensitive belt 1 onto the surface of the transfer drum 2, activation of the transfer roller 26 is prevented, and it is lifted up so as to avoid interference with the toner images being formed on the surface of the transfer drum 2. At the time of transferring the colored toner image onto the paper 31, after completing formation of the same on the transfer drum 2, the transfer roller 26 is activated and is pushed out toward the transfer drum 2 by means of a transfer roller contact and separation unit 27.

An AC decharger 28 is supplied with an AC voltage, and it generates an AC corona, which neutralizes the electric charges remaining on the back face of the paper sheet 31 on which the colored toner image was transferred and removes the same. The decharging functions to facilitate separation of the paper sheet 31 from the transfer drum 2.

The paper sheet 31, after being separated from the transfer drum 2, is delivered toward a fixing roller 29. The fixing roller 29 constitutes a part of a fixing unit 32, and when the delivered paper sheet 31 passes through the fixing roller 29, the colored toner image is thermally fixed on the surface of the paper sheet 31. The paper sheet 31 on which the colored toner image has been thermally fixed is discharged to a paper discharge tray 9 via a paper discharge roller 30.

A drum cleaner 6 removes any toner remaining on the surface of the transfer drum 2. Further, during the process in which a color toner image is formed by repeating the transfer of successive single color toner images onto the surface of the transfer drum 2, the drum cleaner 6 is lifted up to deactivate the cleaning operation, and after completing transference of the colored toner image onto the paper sheet 31, the drum cleaner 6 is pressed onto the surface of the transfer drum 2 to active the same.

A control unit 100 controls each of the above-described operating elements depending on input signals received from an operation panel and input signals received from an information processing unit 200, which will be explained later.

In FIG. 2, the control unit 100 is primarily constituted by a central processing unit (hereinbelow, abbreviated to CPU) 101, a ROM 102 which stores control programs for the CPU 101 and a work memory RAM 103 which is used when the CPU executes the control programs.

An input and output interface (I/F) 104 is used to interface signals when the CPU 101 communicates with the operation panel and an information processing unit, such as a personal computer, and transmits printing data generated by the information processing unit 200 to an exposure control unit 105, which controls the exposure unit 4 to cause it to generate laser beams 10.

A mechanism control unit 106 constitutes a group of control portions which control a group of mechanisms in the process of electrophotographing, and, through control by the CPU 101, outputs a motor drive command signal S1, a developer drive command signal S2, a drum cleaner drive command signal S3 and a charger drive command signal S4; and, in addition, it performs signal input and output operations for controlling such units as a transfer portion 106*e* and a fixing portion 106*f*.

A motor control unit 107 is connected so as to control a motor 20, which drives the photosensitive belt 1, the paper feeding roller 24 and the fixing roller 29, for example. In this regard, it generates a drive signal S7 according to the motor drive command signal S1 provided from a motor portion 106*a* and receives a detection signal S8 indicating an angular displacement amount generated from an encoder 21 directly coupled to a rotary shaft of the motor 20. Further, the motor control unit 107 transmits the detection signal S8 from the encoder 21 as a rotation angle signal S9 for the photosensitive belt 1 to the CPU 101 via an interruption control unit 108.

Figure 3:
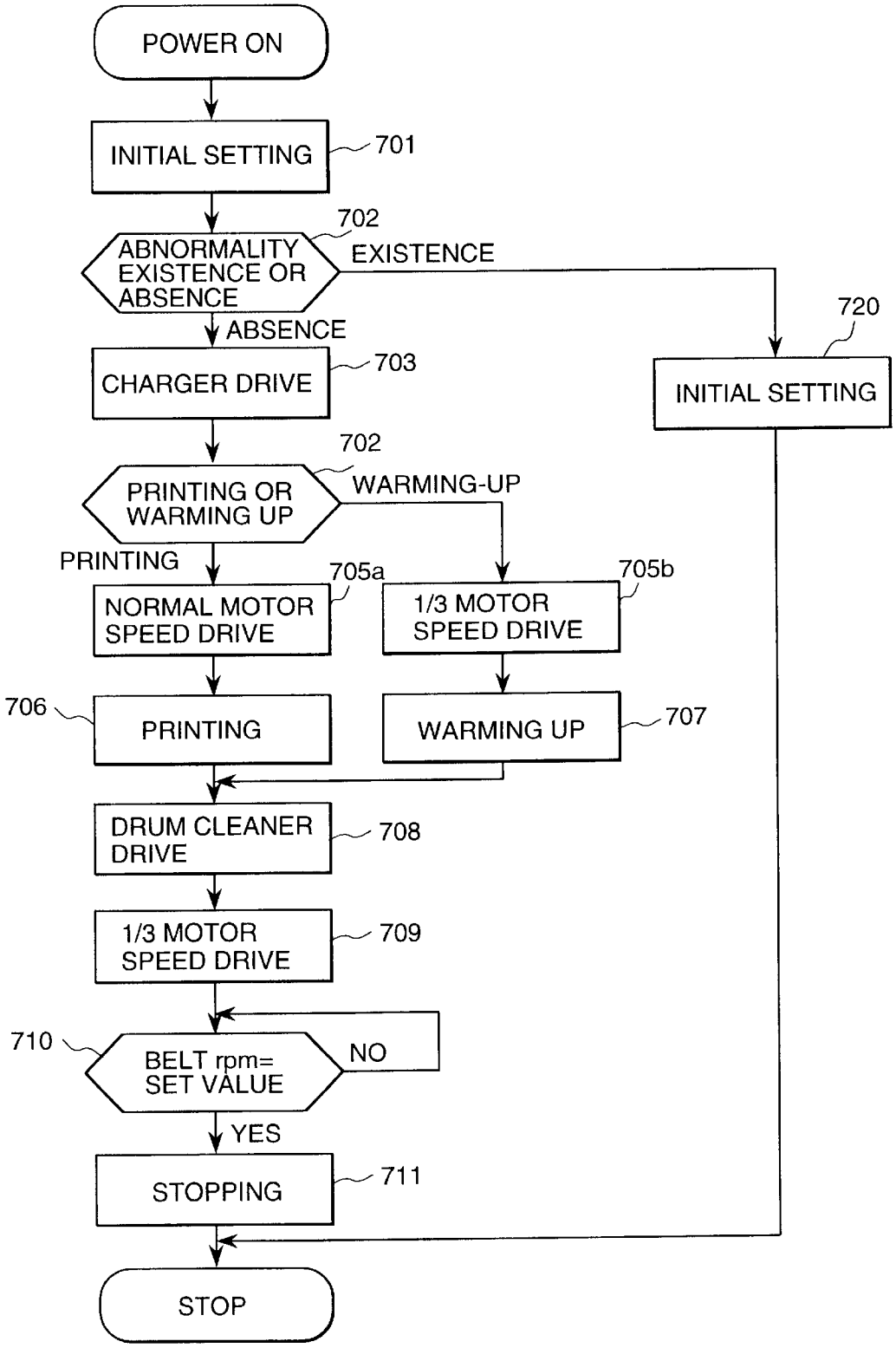
FIG. 3 is a flow chart of a series of operations, including processings for avoiding deterioration due to ozone in the color laser beam printer in FIG. 1.

A series of operations of a color laser beam printer having the above-described constitution, including a process for avoiding deterioration due to ozone, will be explained with reference to the flow chart shown in FIG. 3.

The process of avoiding deterioration due to ozone is started after the power source of the main body is turned on. When the power source is turned on, the CPU 101 performs initialization for $I/O_s$ of control objects and for the interface control unit with the information processing unit 200 (step 701), and the CPU 101 monitors whether or not an abnormality exists within the printer (step 702). If an abnormality is detected, the process branches to an abnormality countermeasure process which depends on the detected abnormality content (step 720).

When no abnormality exists within the printer, the CPU 101 operates to turn on the charging (step 703). In step 703, the changer drive command signal S4 is outputted from the charger portion 106d to drive the charger 7. At this moment, ozone is generated near the changer 7. In this case, when the photosensitive belt 1 is in a stopped state, the photosensitive belt 1 located immediately above the changer 7 so as to be exposed to the ozone at the corresponding portion. Therefore, the motor drive command signal S1 is outputted to the motor control unit 107 to drive the motor 20. Through the rotation of the motor 20, the photosensitive belt 1 is rotated so that the exposure of the same portion of the photosensitive belt 1 to the ozone generated near the charger 7 is prevented.

Subsequently, at step 704, the CPU 101 discriminates the kinds of drive processings in a series of operating conditions of the electrophotographic device, such as printing process and warming-up. In the present embodiment, the drive processings will be explained with reference to the printing process and warming-up.

At first, in a case of the printing process, the processing branches to step 705*a*, and in a case of the warming-up the processing branches to step 705*b*.

The steps 705*a* and 705*b* are process steps in which the motor drive command signal S1 is changed over depending on the kinds of drive processings. In the present embodiment, the motor drive command signal S1 includes four levels, including a normal speed drive command S11, a ½ speed drive command S12, a ⅓ speed drive command S13 and a stop command S10. The motor control unit 107 changes over the drive speed of the motor 20 depending on the outputted level of the motor drive command signal S1 and drives the motor 20 according to the speed commanded by the CPU 101. Thereby, the photosensitive belt 1 driven by the motor 20 is driven at the commanded speed.

The CPU 101 changes over the level of the motor drive command signal S1 depending on kinds of the drive processings.

The step 705*a* is a drive processing for outputting the motor drive command signal S1 for the printing process, for which the normal speed drive command S11 is output. The step 705*b* is a processing for outputting the motor drive command signal S1 for the warming up process, for which the ⅓ speed drive command S13 is output. As has been explained, through the change-over of the motor drive command signal S1, depending on the kinds of processings, the drive speed of the photosensitive belt 1 can be changed over. In the case of the printing process, the CPU 101 executes the printing process at step 706, and in the case of the warming up process, the CPU 101 executes the warming up process at step 707.

After completing the processing at step 706 or step 707, the processing moves to the drum cleaner drive process at step 708.

At step 708, the drum cleaner drive is carried out. The drum cleaner drive signal S3 is outputted from the cleaner portion 106*c* to the drum cleaner control unit 109 to drive the drum cleaner 6. Thereby, any toner which remains on the transfer drum 2 is removed. The signal level of the motor drive command signal S1 at this moment is held at what is set at step 705*a* or 705*b*.

Further, since it is unnecessary to drive the charger 7 at this time, the charging is turned off. Thus, no ozone is generated from now on, and so it is unnecessary to take any measures for exhausting the ozone remaining in the machine.

For the drum cleaner drive at step 708, it is necessary to rotate the drum cleaner 6 more than one rotation in order to remove all of the toner on the transfer drum 2, and so the rotation amount of the drum cleaner 6 is set at two rotations.

Subsequently, when the level of the motor drive command signal S1 is at the normal speed drive command S11 at step 709, the speed level is changed over to the ⅓ speed drive command S13, and when the level is at the ⅓ speed drive command, the level is held as it is. After completing the processing at step 709, the processing moves to a standby process at step 710.

In the standby process, the number of rotations necessary for the photosensitive belt 1 and the output time of the motor drive command signal S1 are calculated depending on the kinds of processings at step 704. This is because the amount of ozone that is generated differs depending on the drive time of the charger 7. For example, when the printing process is performed continuously, or when a warming up process is performed, the drive time of the charger 7 is long, therefore, the output time of the motor drive command signal S1 is set longer; while, on the other hand, when a printing process for a single sheet is performed, the drive time of the charger 7 is short, therefore, the output time of the motor drive command signal S1 is set shorter.

In the present embodiment, the output time of the motor drive command signal S1 is set according to the rotation number of the photosensitive belt 1. For example, when setting a long output time, the rotation number of the photosensitive belt 1 is set at six times; and, when setting a short output time, the rotation number of the photosensitive belt 1 is set at 0. The set values in the present embodiment are determined by the time required to exhaust the ozone within the machine using an ozone exhausting fan (not shown).

With the above-described process, when operations other than the printing process are performed, the speed of the photosensitive belt 1 assumes ⅓ of the normal speed; therefore, if the photosensitive belt 1 is driven for the same time as in the normal speed, the rotation amount of the photosensitive belt 1 assumes ⅓ of the normal speed. Thereafter, the machine stands by until the calculated drive time has passed.

When the output time is set short, since the rotation number of the photosensitive belt 1 is set at 0, the processing immediately moves to the stopping process of step 711. At step 711, the CPU 101 issues commands to stop the respective driven mechanism control portions, so as to stop the operation thereof, and shifts to a standby condition which permits a subsequent printing operation.

As has been explained above, since the level of the motor drive command signal S1 is changed over depending on the kinds of drive processings to be used to perform a variety of processings, the drive speed of the photosensitive belt 1 is changed over, thereby, deterioration of the photosensitive belt 1 due to rotation thereof can be prevented.

Another advantage of the present invention is that, since the motor 20 is used to drive, at the same time, the fixing roller 29 in the fixing unit 32, the rotating speed of the fixing roller 29 is low and operates in synchronism with the speed of the photosensitive belt 1, thereby, the influence of the fixing unit 32 on the life time of the machine is also reduced.

Figure 4:
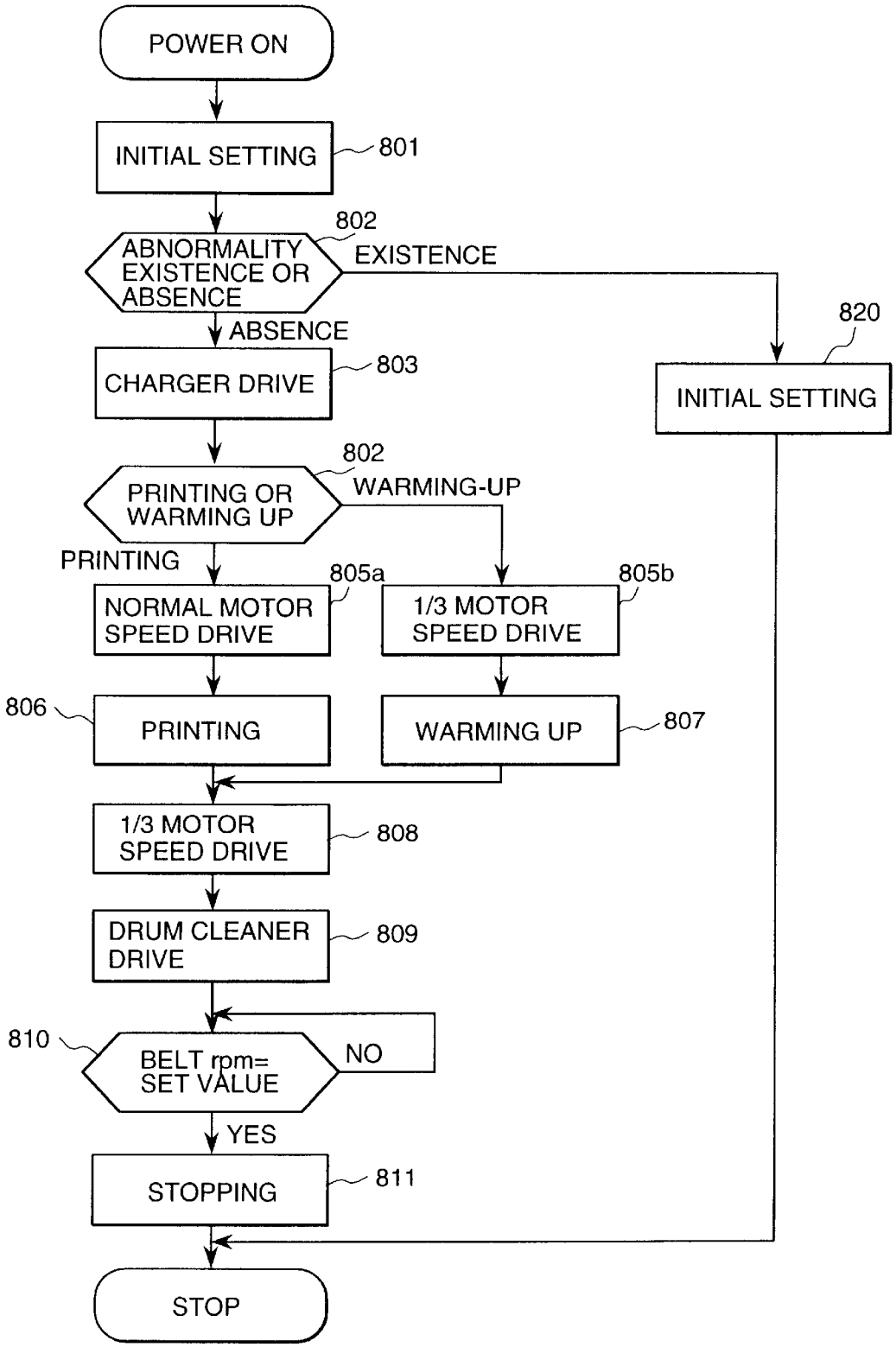
FIG. 4 is a flow chart of another series of operations, including processings for avoiding deterioration due to ozone in the color laser beam printer in FIG. 1.

Another embodiment of the present invention will be explained with reference to the flow chart shown in FIG. 4. In the present embodiment, processings from step 801 to step 806 or to step 807 are performed like steps 701 to 707 in the FIG. 3 embodiment.

Prior to the drum cleaning process at step 809, the motor speed changing process at step 808 is performed, so that the speed of the photosensitive belt 1 is reduced to ⅓ during the drum cleaning process, which can further prevent deterioration of the photosensitive belt 1 due to rotation thereof.

According to the present embodiment, an electrophotographic device which meets both of the requirements to prevent deterioration of the photosensitive belt 1, which occurs due to rotation through performing a variety of processings by changing over the motor drive command signal S1 depending on the kinds of the drive processings, and to respond to an intermittent printing requirement can be provided.

According to the present invention, through speed reduction of the rotating speed of the photosensitive body and the rotating speed of the fixing roller, other than the printing operation, an advantage is attained in that the deterioration of the photosensitive body and the fixing roller due to rotation thereof is prevented, and, at the same time, the deterioration of the photosensitive body and the electrophotographic device due to ozone can be prevented.

What is claimed is:

1. An electrophotographic device which comprises a photosensitive body; a charger which uniformly charges the surface of the photosensitive body; and a motor control unit which performs drive control for a motor which causes to rotate and stop the photosensitive body, characterized in that the motor control unit reduces the rotating speed of the photosensitive body when rotating the same for other than a printing operation lower than the rotating speed thereof when performing the printing operation so as to perform a processing of avoiding deterioration of the photosensitive body due to ozone, and when rotating the photosensitive body after completing the printing operation, the photosensitive body is rotated more than one rotation at the rotating speed during the printing operation, thereafter, the rotating speed of the photosensitive body is reduced.

2. An electrophotographic device of claim 1, further comprising four developers, each of the developers forming a toner image of different color on the photosensitive body, and an intermediate transfer drum having a surface which enables toner images on the photosensitive body to be transferred in an overlapping manner to form a color toner image.

3. An electrophotographic device of claim 1, wherein the photosensitive body is a photosensitive belt.

4. An electrophotographic device which comprises a photosensitive body; a charger which uniformly changes the surface of the photosensitive body; a fixing unit which causes to pass a non fixed toner image held on the surface of a recording paper between two facing rollers of a heating roller and a pressing roller and to melt and fix the toner image on the recording paper by heating and pressing; and a motor control unit which performs drive control of a motor for rotating and stopping the photosensitive body and the heating roller and the pressing roller in the fixing unit, characterized in that the motor control unit reduces the rotating speed of the photosensitive body and the heating roller and the pressing roller in the fixing unit when rotating the same for other than printing operation lower than the rotating speed thereof when performing the printing operation.

5. An electrophotographic device of claim 4, further comprising four developers, each of the developers forming a toner image of different color on the photosensitive body, and an intermediate transfer drum having a surface which enables toner images on the photosensitive body to be transferred in an overlapping manner to form a color toner image.

6. An electrophotographic device of claim 4, wherein the photosensitive body is a photosensitive belt.

* * * * *